US005341939A

United States Patent [19]

Aitchison et al.

[11] Patent Number: 5,341,939

[45] Date of Patent: Aug. 30, 1994

[54] MULTIPLE DECK VIBRATING SCREEN APPARATUS

[75] Inventors: David J. Aitchison, Tempe; Donald C. Dunn, Mesa, both of Ariz.

[73] Assignee: Corrosion Engineering, Inc., Mesa, Ariz.

[21] Appl. No.: 20,359

[22] Filed: Feb. 22, 1993

[51] Int. Cl.[5] ..... B07B 1/28

[52] U.S. Cl. ..... 209/319; 209/404; 209/405

[58] Field of Search ..... 209/309, 311, 315, 317, 209/319, 404, 405, 331

[56] References Cited

U.S. PATENT DOCUMENTS

| | | | |
|---|---|---|---|
| 1,985,167 | 12/1934 | Hatfield | 209/319 X |
| 2,156,716 | 5/1939 | Beckwith | 209/319 X |
| 2,359,431 | 10/1944 | Loucks | 209/404 |
| 2,510,741 | 6/1950 | Coon | 209/315 X |
| 2,984,356 | 5/1961 | Bruninghaus | 209/319 |
| 5,037,535 | 8/1991 | Bruderlein | 209/331 X |
| 5,156,749 | 10/1992 | Williams | 209/404 X |

FOREIGN PATENT DOCUMENTS

| | | | |
|---|---|---|---|
| 1360818 | 12/1987 | U.S.S.R. | 209/319 |
| 1424874 | 9/1988 | U.S.S.R. | 209/319 |

*Primary Examiner*—D. Glenn Dayoan
*Assistant Examiner*—Tuan N. Nguyen
*Attorney, Agent, or Firm*—LaValle D. Ptak

[57] ABSTRACT

A vibrating screen apparatus for effecting screening of materials includes a frame with first and second vibrating screen deck units mounted one above the other in it. To provide maximum flexibility of operation, the vibrating deck units are pivoted at the material feed end on the frame. Hydraulic cylinders are attached between the free ends of the first and second vibrating screen deck units and the frame for independently varying the angle or slope of each of the deck units, relative to the frame, for adjusting the dwell time of material passing over the deck units. A flexible corrugated rubber curtain extends between the upper deck unit and the lower deck unit to ensure that material which passes through the upper deck unit is guided onto the surface of the lower deck unit. In addition, each of the vibrating screen deck units has an independent vibrator mechanism on it; so that the vibration rate and magnitude may be independently adjusted for each of the deck units in the system.

10 Claims, 2 Drawing Sheets

MULTIPLE DECK VIBRATING SCREEN APPARATUS

BACKGROUND

Vibrating material sorting screens are used in a variety of applications, including sand and gravel businesses and in mining operations. Such vibrating screens are used to sort material size, and typically comprise an elongated deck, which slopes downwardly from the feed end to the material delivery end. Usually, the decks are mounted in a deck holding frame, which, in turn, is supported on springs extending to a platform on a support surface. An eccentric vibrator is employed to vibrate the frame on the springs to cause a shaking of the material poured onto the vibrating screen deck to facilitate the movement of the material down the deck, and to expedite the material separation. Both the aperture of the screen and the size of the deck determines the separation size of the materials, and any material which is larger than the screen aperture finally is supplied from the end of the deck to a suitable receptacle. All material which is smaller than the screen aperture falls through the deck for further separation or processing.

In some mining applications, the vibrating screen apparatus has two decks located one above the other, with the larger screen aperture on the top deck and a smaller screen aperture on the lower deck. In the sand and gravel business, three to five decks frequently are used, with the decks progressing in screen aperture from the largest at the top to the smallest at the bottom. Usually, all of these decks are mounted together in a single frame, vibrated by a single vibrating apparatus. The slope of each deck, from the feed end or material receiving end to the delivery end, is fixed once the vibrating screen apparatus is assembled. In addition, a single vibrating weight and drive motor is used; so that the magnitude and frequency of vibration of the entire unit is the same.

When a multiple deck vibrating screen unit is employed, the magnitude and frequency of the vibration necessarily is a compromise between the optimum magnitude and speed of vibration required for the deck separating the larger size materials and the magnitude and speed of vibration required for the deck which is separating the smaller sized materials. In addition, the rate at which materials traverse the deck from the feed end to the delivery end varies, depending upon the size of the material; so that a compromise generally is made in the slope of the decks during the manufacturing of a multiple deck unit. In some cases, the slope angle of the different decks can be made to vary relative to one another; but once the unit is made, the different slope angles cannot further be adjusted in a typical deck.

When multiple deck units having three or more decks are employed, the compromises, which must be reached between the slope or angle of the different decks and the magnitude and speed of the vibrator, result in ever greater departures from the optimum, which would be desired for each deck having a single screen size. In view of this, it is desirable to provide a vibrating screen apparatus for a multiple deck unit which may be operated with each deck vibrated independently of the others, and where the angle or slopes of the decks may be independently varied, as desired.

SUMMARY OF THE INVENTION

It is an object of this invention to provide an improved vibrating screen apparatus.

It is another object of this invention to provide an improved multiple deck vibrating screen apparatus.

It is an additional object of this invention to provide an improved multiple deck vibrating screen apparatus where the slopes of the decks may be varied independently of one another.

It is a further object of this invention to provide a multiple deck vibrating screen apparatus in which the vibration frequency and magnitude of each of the decks is independent of the others.

It is yet another object of this invention to provide an improved multiple deck vibrating screen apparatus in which the magnitude and frequency of the vibration of each deck is independent of the others, and in which the slopes of each deck may be dynamically independently varied of the slope of the other decks.

In a preferred embodiment of the invention, a vibrating screen apparatus has a frame. At least one vibrating screen deck, having first and second ends, is pivotally mounted at the first end on the frame. The vibrating screen deck then further is provided with means for rotating the deck about the pivot to vary the angle or slope of the deck relative to the frame; and apparatus is provided for vibrating the deck.

In a mole specific embodiment of the invention, at least two vibrating screen decks are mounted on the frame, one above the other. Each of the decks is independently vibrated of the other; and each of the decks is pivotally mounted for independent adjustment of the angle or slope of the deck relative to the frame.

DETAILED DESCRIPTION

Reference now should be made to the drawings, in which the same reference numbers are used in the different figures to designate the same components.

Figure 1:
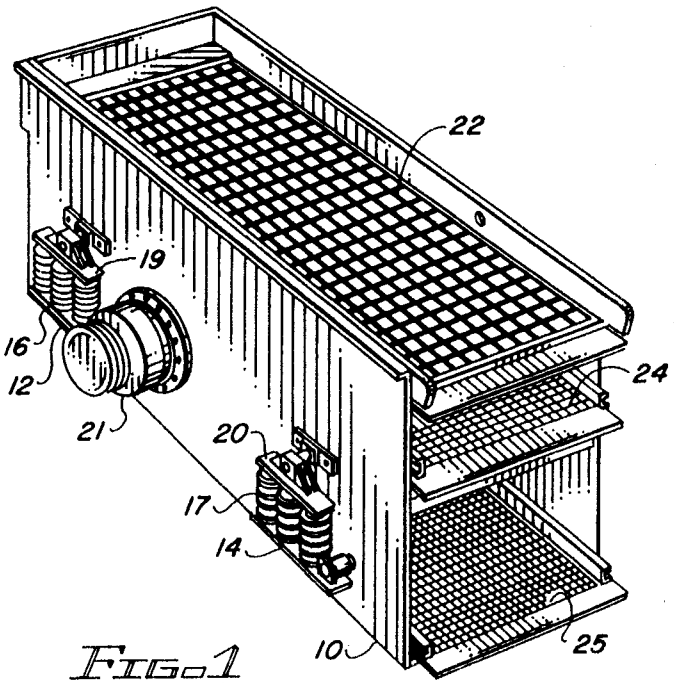
FIG. 1 (PRIOR ART)
FIG. 1 is a perspective view of a typical prior art multiple deck vibrating screen unit.

FIG. 1 is a perspective view of a typical prior art construction used for a multiple deck vibrating screen unit. In the construction of such units, a screen deck holding frame 10 is employed to mount a plurality of stacked vibrating screens 22, 24 and 25, each having different mesh sizes, with the largest size located in the top screen 22. The frame 10, which holds the screens 22, 24 and 25, then is mounted through coil springs 16 and 17 on a pair of front and rear mounting plates 12 and 14 (on each side of the frame 10). The plates 12 and 14 are secured to a suitable support surface, such as a concrete foundation or the like. A large eccentric weight vibrator 21 is attached to the frame 10 to shake or vibrate the entire unit at the frequency and amplitude determined by the vibrator 21. Consequently, material which is dumped onto the top screen 22 is vibrated at the same frequency and amplitude as the material which is dropped onto the lower screens 24 and 25.

Once the unit of FIG. 1 is assembled, the slope of each of the screens 22, 24 and 25, relative to one another, is fixed. Also, as mentioned above, the entire unit is vibrated as a unitary assembly; so that the amplitude and frequency of vibration is the same for all of the screens.

Figure 3:
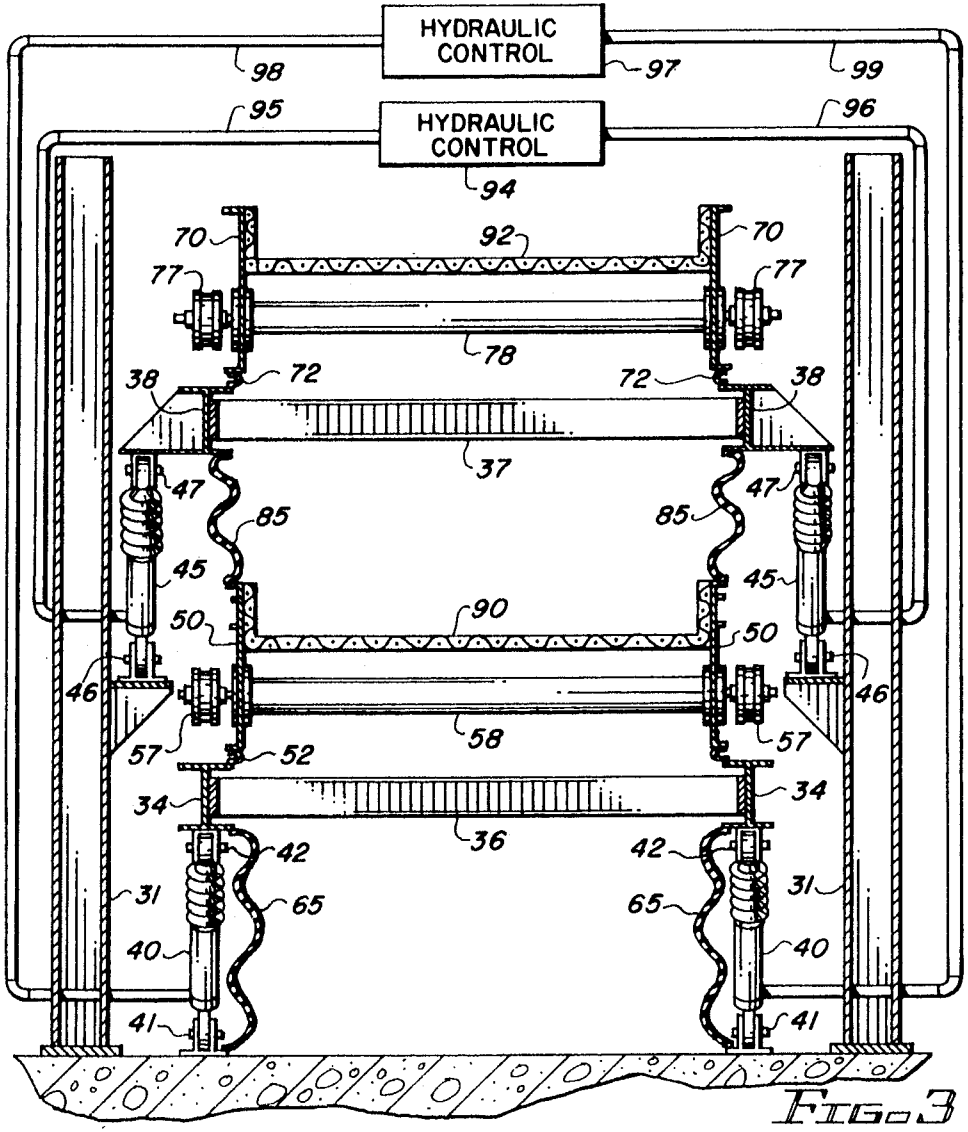
FIG. 3 is an end view of the embodiment shown in FIG. 2.
Figure 2:
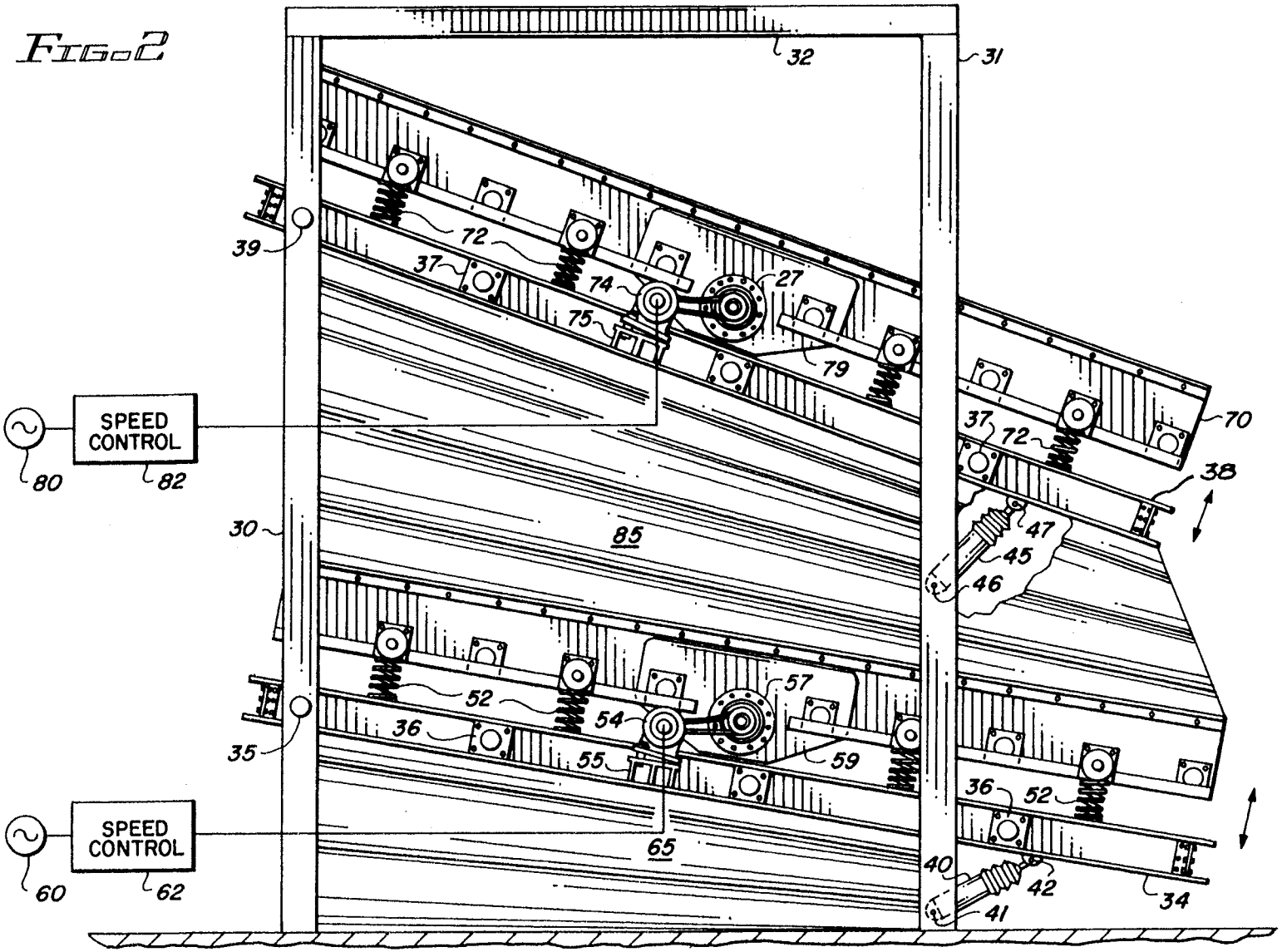
FIG. 2 is a side view of a preferred embodiment of the invention.

The device shown in FIGS. 2 and 3 is designed to provide optimum operation of a multiple deck or multiple screen vibrating structure by providing independent vibration of each of the screens, and an independent adjustment of the slope or angle of the screens relative to one another and relative to the frame in which the screens are mounted. Consequently, in the device shown in FIGS. 2 and 3, the slope of the different screens may be ideally adjusted for the particular material which is being separated by the unit; and the vibration amplitude and frequency of each of the screens may be independently adjusted to provide the optimum operation for each screen, without compromising that operation in order to make adjustments for a different vibration and frequency, which is the optimum for one or more of the other screens in the unit.

In the device shown in FIGS. 2 and 3, a stacked deck unit is shown employing two vibrating screen decks. It is readily apparent, however, that the principles of the operation of the system, which is shown in FIGS. 2 and 3, may be extended to vibrating screen decks of more than two decks.

In the device illustrated in FIGS. 2 and 3, a main frame comprised of upright support members 30 and 31, interconnected at the top by a support beam 32, is mounted on a suitable surface, which may be a concrete foundation or the like. This frame unit 30, 31 and 32 is fixed in place and does not vibrate. Consequently, this frame may be made of relatively massive heavyweight materials.

A pair of sub-frames 34/36 and 37/38, on which vibrating screen decks 50 and 70, respectively, are mounted, are attached at one end through pivots 35 and 39, respectively, on the upright frame member 30. This attachment permits the free end of the screen support frames 34 and 38 to move generally up and down in the direction of the arrows shown in FIG. 2.

The slope of each of the vibrating screen support frames 34 and 38 is established by sets of hydraulic cylinders 40 and 45, respectively. The cylinders 40 (shown in both FIGS. 2 and 3) are pivotally attached at their lower ends 41 to the upright frame member 31, and at their upper ends 42 to the lower side of the support frame 34. Similarly, the hydraulic cylinders 45 are pivotally attached at their lower ends 46 to the upright 31, and at their upper ends 47 to the lower side of the support frame 38. Consequently, as the pistons in the hydraulic cylinders 40 and 45 are extended and retracted, the free ends of the support frames 34 and 38 are moved up and down relative to the ends attached by the pivots 35 and 39, as illustrated by the arrows in FIG. 2. This permits an adjustment of the slope of the vibrating screen decks 50 and 70, independently of one another, to obtain the optimum slope for the size of material which is being screened by each of the decks 50 and 70.

As shown most clearly in FIG. 2, the vibrating screen deck 50 is mounted on the support frame 34/36 by means of a rubber mount or coil spring supports 52. Similarly, the vibrating screen deck 70 is mounted on the support frame 37/38 by means of a rubber mount or coil springs 72.

Vibration for the deck 50 is effected by means of a rotary vibrator 58 (FIG. 3), which is pivotally mounted at each end on a bearing unit 57. The vibrator 57/58 is rotated or driven by means of a drive belt from an electric motor 54, which is mounted on a bracket 55 attached to the support plate 34. Operating power for the motor 54 is obtained from a suitable source 60 through a speed control 62. It is noted that the motor is mounted on the relatively stable non-vibrating frame 34; and the vibrator 57/58 is driven by means of the drive belt to vibrate the unit 50 on the rubber mounts or springs 52. This construction substantially isolates the vibration of the vibrating screen deck 50 from the support frame 34/36 and from the main frame 30, 31 and 32.

A similar independent vibration of the upper vibrating screen deck 70 is effected by means of a vibrator 78, which is pivotally mounted at each end on bearings 77 on each side of the vibrating screen deck. A second independent electric motor 74, mounted on a 4 mount 75 on the frame 38, drives the vibrator 78 through a drive belt to independently vibrate the deck 70 from the vibration of the deck 50. An independent power supply 80 and speed control 82 is provided for the motor 74; so that speed and amplitude of the vibration of the deck 70 may be controlled entirely independently of the speed and amplitude of the vibration of the deck 50. Consequently, the optimum speed and amplitude of vibration for each of the decks 50 and 70 may be independently selected by the apparatus shown.

As illustrated in FIG. 3, the decks 50 and 70 each have vibrating screens 90 and 92, respectively, mounted on them for screen screening or sorting larger size material on the deck 92 and smaller size material on the deck 90. The smaller material, which is separated by the screen 92, drops down onto the deck 90. To ensure that this material does not fall outwardly over the sides of the deck 90, flexible corrugated rubber curtain material 85 is stretched between the top of the deck 50 and the bottom of the frame 38 supporting the upper vibrating screen deck 70. Similarly, a corrugated rubber curtain 65 is attached to the lower side of the frame 34 for the lower vibrating screen 50; and the curtain 65 extends to the ground or support surface beneath the frame 30, 31 and 32. This is illustrated in both FIGS. 2 and 3. By employing flexible corrugated side material 65 and 85, positioned as illustrated in FIGS. 2 and 3, instead of using rigid sides, the independent adjustment of the height of the delivery end of the vibrating screen frames 34 and 38 relative to the left-hand or feed end (FIG. 2) of the screens readily may be effected. The material 65 and 85 either is extended or compressed, in accordance with the relative positions of the frames 34 and 38, which are effected to obtain the optimum slopes of each of the vibrating screen decks carried by these frames.

As illustrated in FIG. 3, separate hydraulic control units 94 and 97 are used for the cylinders 40 and 45, respectively. The control unit 94 is shown as connected to the hydraulic cylinders 40 on opposite sides of the support frame 34 by means of lines 95 and 96. Similarly, the hydraulic control unit 97 is illustrated as connected to the hydraulic cylinders 45 on opposite sides of the support frame 38 by means of hydraulic lines 98 and 99. The illustration of the hydraulic controls 94 and 97, and the interconnections with the hydraulic cylinders 40 and 45, is merely a schematic representation to illustrate the independent controls of the cylinders 40 and 45 which is effected.

It should be noted that by providing independent angle or slope adjustment of the vibrating screen decks 50 and 70 and by providing independent vibration of these decks, it is possible to effect dynamic adjustments of the slopes of the screen decks 50 and 70 even during the material separating operation. Consequently, if the initial settings of the screen slopes are not producing the results which are desired or expected, the hydraulic controls 94 and 97 may be operated to obtain the necessary slopes,independently for each of the vibrating screen decks 50 and 70. The independent vibration of the decks 50 and 70 also permits optimum adjustment. If fixed weight vibrators 58 and 78 are used, the desired eccentric weights, which produce the most effective result for the material size being screened, may be independently mounted in each of the units. If variable vibrator weights are employed, it is possible to change or modify the weights 58 and 78 during the operation of the unit to provide the optimum adjustment of the operating conditions, independently, for each of the screen decks 50 and 70.

The foregoing description of the preferred embodiment of the invention is to be considered as illustrative, and not as limiting. Various changes will occur to those skilled in the art without departing from the true scope of the invention as defined in the appended claims.

We claim:

1. A vibrating screen apparatus for material screening including in combination:

a frame;

at least first and second elongated vibrating screen decks having first and second sides and first and second ends;

first and second pivot means for pivotally mounting the first ends of said first and second vibrating screen decks, respectively, on said frame, with said first vibrating screen deck located above said second vibrating screen deck;

first and second means coupled with first and second said vibrating screen decks, respectively, for rotating said first and second vibrating screen decks about said first and second pivot means for varying the angle of said first and second vibrating screen decks relative to said frame;

means for vibrating said first and second vibrating screen decks; and flexible curtain members extending between the first sides and the second sides, respectively, of said first and second vibrating screen decks to ensure that material falling through said first vibrating screen deck drops onto said second vibrating screen deck.

2. The combination according to claim 1 wherein said first and second means coupled to said first and second vibrating screen decks for rotating said decks about said first and second pivot means independently rotates said first and second decks about said first and second pivot means.

3. The combination according to claim 2 wherein said first and second means for rotating said first and second vibrating screen decks are coupled between said frame and the second ends of said first and second vibrating screen decks, respectively.

4. The combination according to claim 3 wherein said pivot means are located on said frame at a material feed end of said vibrating screen decks.

5. The combination according to claim 4 wherein said first and second means for rotating said first and second vibrating screen decks comprise first and second hydraulic members, respectively.

6. The combination according to claim 5 wherein said means for vibrating said vibrating screen decks comprises first and second vibrators coupled with said first and second vibrating screen decks, respectively, for independently vibrating said first and second vibrating screen decks.

7. The combination according to claim 1 wherein said means for vibrating said vibrating screen decks comprises first and second vibrators coupled with said first and second vibrating screen decks, respectively, for independently vibrating said first and second vibrating screen decks.

8. The combination according to claim 1 wherein said first and second means for rotating said first and second vibrating screen decks are coupled between said frame and the second ends of said first and second vibrating screen decks, respectively.

9. The combination according to claim 8 wherein said first and second means for rotating said first and second vibrating screen decks comprise first and second hydraulic members, respectively.

10. The combination according to claim 1 wherein said flexible curtain members comprise corrugated rubber-like sheets.

* * * * *